United States Patent [19]

Goldmann

[11] 4,119,848

[45] Oct. 10, 1978

[54] IONOGRAPHIC RECORDING OF X-RAY IMAGES

[75] Inventor: Gerd Goldmann, Taufkirchen, Germany

[73] Assignee: Siemens Aktiengesellschaft, Berlin & Munich, Germany

[21] Appl. No.: 803,213

[22] Filed: Jun. 3, 1977

[30] Foreign Application Priority Data

Jun. 10, 1976 [DE] Fed. Rep. of Germany ..... 2626068

[51] Int. Cl.[2] ..... G03G 5/022; G03G 15/00; G03G 16/00

[52] U.S. Cl. ..... 250/315 A; 350/162 ZP

[58] Field of Search ..... 250/315 A, 315; 350/162 ZP

[56] References Cited

U.S. PATENT DOCUMENTS 4,002,906 1/1977 Pekau et al. ..... 250/315 A

*Primary Examiner*—Alfred E. Smith
*Assistant Examiner*—T. N. Grigsby
*Attorney, Agent, or Firm*—Hill, Gross, Simpson, Van Santen, Steadman, Chiara & Simpson

[57] ABSTRACT

In the illustrated embodiments the undersurface of the thermoplastic coating and the associated electrode are formed with a corrugated structure to produce a correspondingly regularly varying electric field at the exposed thermoplastic surface. The spacing between corrugations is much smaller than the desired x-ray image resolution so that the developed image in effect modulates the regular variation produced by the corrugations. Where the original corrugations are derived from an off-axis zone plate, the developed image can be read out by means of a divergent incident light beam.

6 Claims, 6 Drawing Figures

IONOGRAPHIC RECORDING OF X-RAY IMAGES

BACKGROUND OF THE INVENTION

The invention relates to a device and a process for ionographically recording x-ray images in a thermoplastic coating.

Such a device and a corresponding process are known from German inspection specification No. 2,436,894. According to this specification, a thermoplastic coating is disposed on a heatable substrate in an ionization chamber. The ionization chamber contains a rare gas of high atomic number such as xenon for example. If x-rays from an object being examined pass into this ionization chamber, the rare gas is ionized. The rare gas ions are brought onto the thermoplastic coating by an electric field generated by means of two electrodes in the ionization chamber. This produces a charge pattern corresponding to the spread of intensity in the x-ray beam on the thermoplastic coating.

This charge pattern on the surface of the thermoplastic coating is developed in that the thermoplastic coating is briefly heated and thus softened, then the thermoplastic coating is cooled again. During the brief heating of the thermoplastic coating a superficial relief pattern forms which corresponds to the spread of the charge over the thermoplastic coating. Thus once the thermoplastic coating has cooled down, we have a permanent relief image matching the spread of the charge and thus the spread of intensity in the x-ray beam.

SUMMARY OF THE INVENTION

The object of the invention is to produce a gray-tone reproduction from such a thermoplastic coating.

This object is achieved with a thermoplastic coating for ionographically recording x-ray images wherein to form an electrically efficient grid the thermoplastic coating is provided with a corrugated structure on the side thereof facing the substrate, the associated electrode being in the form of a lamina applied on the corrugated side of the thermoplastic coating and exhibiting a corresponding corrugated structure.

In one particularly preferred embodiment example this corrugated structure takes the form of an off-axis zone plate.

Advantageously these corrugated structures can be produced very easily. To this end a coating of photoresist is exposed by means of two coherent light beams; by virtue of the interference of the light beams the coating of photoresist is exposed with a suitable beam geometry according to the desired corrugated structure. On subsequent development a corrugated structure is then formed. This can be transferred to the thermoplastic coating; the details are described further below.

The x-ray image to be recorded is screened by virtue of the corrugated structure of the thermoplastic coating. Such a screening technique can be termed a local carrier frequency process in which the high frequency carrier, here the corrugated structure, is amplitude-modulated with a low frequency signal, here the x-ray image.

This modulation is achieved in that when the thermoplastic coating is developed, an electrical field is active in the coating, the field strength of which is periodically modulated by the corrugated structure. The electrical field is generated by a transparent electrode coating lying on the corrugated interface of the thermoplastic coating facing the substrate, i.e. this electrode coating is also corrugated.

Such periodic field variations per se can also be produced by a grid-shaped electrode. But the electrode material also exhibits light absorption properties, i.e. such a grid-shaped electrode would act as an optical absorption grid, which might cause a troublesome background when the image is read off the thermoplastic coating. In contrast a corrugated electrode coating works not as an absorption grid but as a phase grid. However this phase-grid action is negligibly small when the refractive indices of the substrate and the thermoplastic coating are the same or nearly the same, as is provided in one advantageous embodiment of the invention.

The spacing between the individual corrugations in the corrugated structure should be roughly ten times smaller than the smallest gap between the lines still to be resolved on the x-ray image to be recorded. The smallest line gap is limited by the ionization chamber; lines exhibiting a gap of more than 0.1 mm can still be distinguished. Accordingly the spacing between the corrugations in the corrugated structure should be less than 0.01 mm.

Other objects, features and advantages of the present invention will be apparent from the following detailed description taken in connection with the accompanying sheets of drawings.

DETAILED DESCRIPTION

Figure 1:
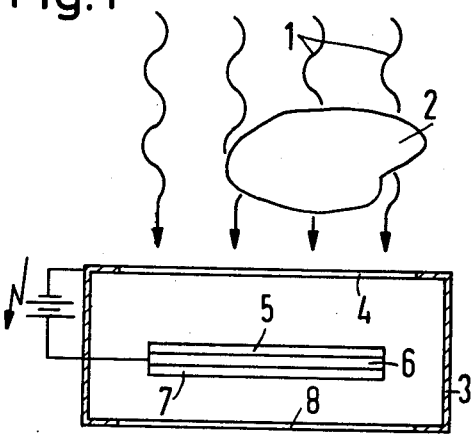
FIG. 1 is a diagrammatic illustration of a known device for ionigraphically recording x-ray images in a thermoplastic coating.

Description of FIG. 1

FIG. 1 shows a known system for ionographically recording x-ray images in a thermoplastic coating. Reference numeral 1 denotes the x-rays that are to be recorded after passing through an object 2. The ionization chamber 3 is filled with a rare gas under pressure. On the inlet side, the ionization chamber 3 is provided with an inlet window 4 constituted by an electrode through which optical rays can pass. The thermoplastic coating 5 lies on a heating coating 6 which again rests on a substrate 7 through which optical rays can pass. Reference numeral 8 denotes an outlet window in the ionization chamber. Now a high voltage is applied between the inlet window 4 in the form of a transparent electrode and the transparent heating coating 6 which serves as counter-electrode, as a result of which the ions produced in the rare gas by the impinging x-rays wander along the electrical field lines and generate a charge pattern on the exposed surface of the thermoplastic coating. Brief heating of the thermoplastic coating converts this charge pattern into a corresponding surface relief pattern. In this way the information to be stored, i.e. in this case the x-ray image, is recorded in the thermoplastic coating in the form of a phase structure.

Figure 2:
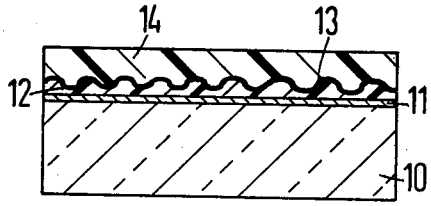
FIG. 2 is a diagrammatic sectional view illustrating a first embodiment of a device for ionographically recording x-ray images.

Description of FIG. 2

In a first embodiment example a heating coating 11, e.g. a Balzer Aurell heating coating, lies on a glass substrate 10 as in FIG. 2. This heating coating is covered with a coating of photoresist 12. This coating of photoresist 12 is exposed with two interfering coherent light beams; after development the surface of this coating of photoresist 12 exhibits a corrugated structure as shown in FIG. 2. An electrode 13 is now applied to this corrugated coating of photoresist by vapor deposition. Then the thermoplastic coating 14 is applied. This can be done for instance simply by casting the thermoplastic material on top.

If the electrode 13 simultaneously forms a heating coating, the heating coating 11 can be omitted.

Figure 3:
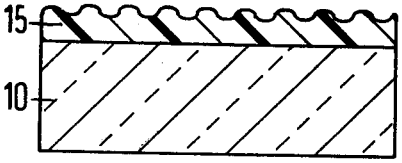
FIG. 3 is a diagrammatic view illustrating a step in the formation of a second embodiment of the present invention.
Figure 4:
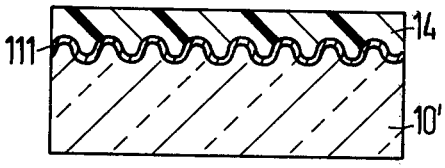
FIG. 4 is a diagrammatic view illustrating a device for ionographically recording x-ray images in accordance with the second embodiment.

Description of FIGS. 3 and 4

In a further embodiment, as in FIG. 3, a coating of photoresist 15 is applied directly on the glass substrate 10 and is exposed with two interfering coherent light beams so that the coating of photoresist exhibits a corrugated structure when developed. This structure in the coating of photoresist is now transferred into the surface of the glass substrate lying underneath the photoresist coating by etch-sputtering.

As shown in FIG. 4 we now have a glass substrate 10' with a corrugated structure. Now an electrode and heating coating 111 is applied on the corrugated structure of the substrate, e.g. by vapor deposition. ZnO, Ni/An or Aurell for example can serve as material for this. Next a thermoplastic coating 14 is applied as has already been described in connection with FIG. 2.

Figure 5:
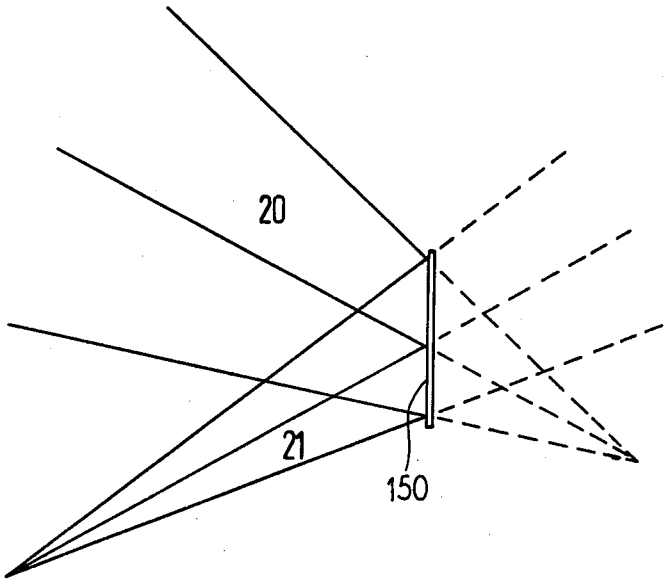
FIG. 5 shows the production of the corrugated structure for either the embodiment of FIG. 2 or FIGS. 3 and 4.

Description of FIG. 5

The corrugated structure in the coating of photoresist 12 or 15 is made by two-beam interference.

For this the light beams which act on the coating of photoresist and mutually interfere there can be flat waves. If the coating of photoresist is now developed after exposure, a corrugated structure is produced with straight parallel corrugations with an unchanging grid constant.

In order to give the corrugated structure the form of an off-axis zone plate (hologram), a convergent light beam 20 and a divergent light beam 21 are made to interfere on the coating of photoresist 150 as in FIG. 5. Both light beams 20 and 21 have coherent light of the same wavelength. In this case when the coating of photoresist 150 is developed a corrugated structure is generated in which the corrugations form concentric circles with variable grid constant.

A section cut from a zone plate and lying at the side near the optical axis of the zone plate acts as a prism for an incident light beam and, with the two-beam interference described here, as a focusing lens.

In a manner known per se the thermoplastic coatings 14 in accordance with the invention serve for recording x-ray images as was explained in connection with FIG. 1. When the thermoplastic coating is briefly heated, a profile forms in the thermoplastic coating corresponding to the structure of the object photographed and simultaneously overlaid with a grid-shaped structure. Thus the exposed surface of the thermoplastic coating receives a structure which is an image of the object photographed and is overlaid with the corrugated structure. This corrugated structure in the exposed surface of the thermoplastic coating arises through the changing electrical field strengths within the thermoplastic coating; this irregular field strength is produced by the corrugated electrode 13 or 111 on the underside of the thermoplastic coating 14.

Figure 6:
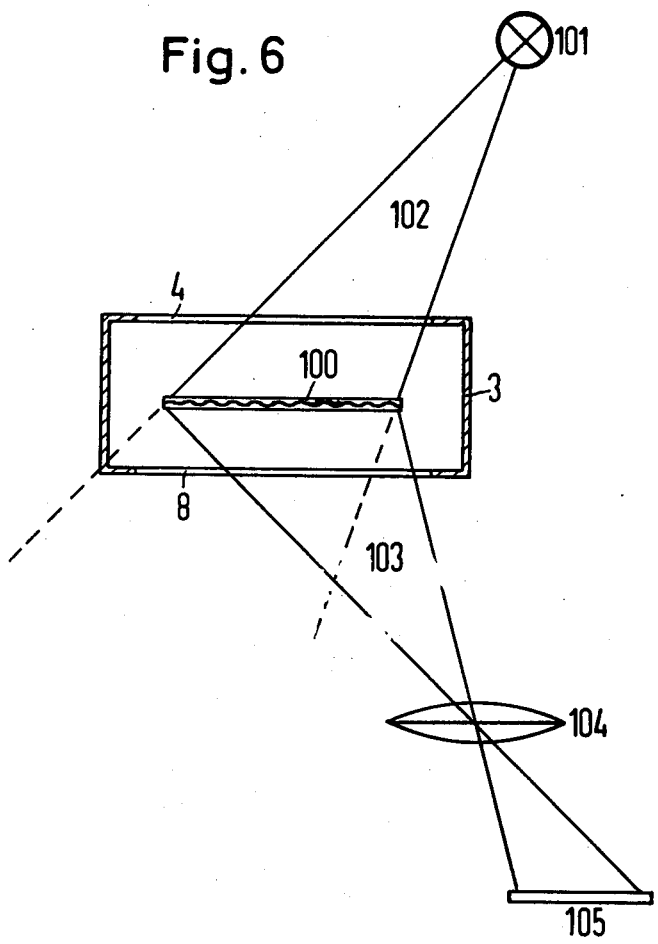
FIG. 6 is a diagrammatic view illustrating how the information stored in a device according to the first or second embodiment is read off.

Description of FIG. 6

The way in which the information recorded in the thermoplastic coating is read off is explained in conjunction with FIG. 6. Here corresponding items have the same reference numbering as in FIG. 1. The thermoplastic coating 100 is made in accordance with the invention as in FIG. 2 or 4. In addition this coating has to be made in the form of an off-axis zone plate as has been further described above. With this it is possible to use a divergent light beam 102 for reading out the information. This light beam is generated by a light source 101 which can be disposed outside the optical axis of the x-ray beam. Since the thermoplastic coating is constituted by an off-axis zoned plate, part of the incident light beam 102 is broken off to the side by the off-axis zoned plate and in addition the beam is focused by virtue of the lens characteristics of the off-axis zoned plate; thus a convergent emergent beam 103 is produced. This emergent beam is focused on an image plane 105 by means of a lens 104. If coherent light is used for the incident light beam 102, a gray-tone image is formed on the image plane 105, this image being a reproduction of the object 2 recorded by the x-rays.

This FIG. 6 shows the advantage of constituting the thermoplastic coating as an off-axis zone plate with particular clarity. The light source 101, the lens 104 and the image plane 105 can be disposed outside the path taken by the x-rays. It is also advantageous that the incident light beam 102 can be divergent; in effect the thermoplastic coatings can be very extensive in area, so it would mean considerable cost in terms of optics if the incident light beam had to consist of parallel light beams as would be the case with the other corrugated structure described.

In one embodiment example use was made of the thermoplastic material Fe 198 available from Kalle AG. The thermoplastic coating was about 1.6 $\mu$m. The depth of the corrugated structure varied between 0.05 $\mu$m and 0.5 $\mu$m. A suitable photoresist is Shipley AZ 1350 for instance.

It will be apparent that many modifications and variations may be effected without departing from the scope of the novel concepts and teachings of the present invention.

I claim as my invention:

1. A device having a thermoplastic coating for ionographically recording x-ray images in which connection this thermoplastic coating forms a laminate with a transparent substrate and this laminate has disposed on it a transparent heating coating and an electrode in the form of a lamina, characterized in that to form an electrically efficient grid on the side facing the substrate 10, 10' the thermoplastic coating 14 exhibits a corrugated structure and in that the electrode 13, 111 in the form of a lamina is applied on this corrugated side of the thermoplastic coating 14 and exhibits a corresponding corrugated structure.

2. A device as in claim 1, characterized in that the thermoplastic coating and the substrate have at least approximately the same refractive index.

3. A device as in claim 1, characterized in that a coating of photoresist 12 lies between the thermoplastic coating 14 and the substrate 10.

4. A device as in claim 1, characterized in that the electrode in the form of a lamina is also constituted as a heating coating.

5. A device as in claim 1, characterized in that the corrugated structure corresponds to an off-axis zone plate.

6. A device as in claim 2, characterized in that the corrugated structure corresponds to an off-axis zone plate.

* * * * *